US011291878B2

(12) United States Patent
Carosella

(10) Patent No.: US 11,291,878 B2
(45) Date of Patent: Apr. 5, 2022

(54) QUAD EXERCISER

(71) Applicant: Michael Carosella, Staten Island, NY (US)

(72) Inventor: Michael Carosella, Staten Island, NY (US)

( * ) Notice: Subject to any disclaimer, the term of this patent is extended or adjusted under 35 U.S.C. 154(b) by 11 days.

(21) Appl. No.: 16/832,322

(22) Filed: Mar. 27, 2020

(65) Prior Publication Data

US 2020/0306576 A1 Oct. 1, 2020

Related U.S. Application Data

(60) Provisional application No. 62/824,414, filed on Mar. 27, 2019.

(51) Int. Cl.

| | |
|---|---|
| ***A63B 21/065*** | (2006.01) |
| ***A63B 21/00*** | (2006.01) |
| ***A63B 23/035*** | (2006.01) |
| ***A63B 23/04*** | (2006.01) |
| ***A63B 21/04*** | (2006.01) |

(52) U.S. Cl.

CPC ..... *A63B 21/065* (2013.01); *A63B 21/00065* (2013.01); *A63B 21/0442* (2013.01); *A63B 21/4011* (2015.10); *A63B 23/03508* (2013.01); *A63B 23/04* (2013.01); *A63B 2225/09* (2013.01)

(58) Field of Classification Search

CPC ..... A63B 21/065; A63B 21/00065; A63B 21/0442; A63B 23/03508; A63B 23/04; A63B 2225/09; A63B 2209/10; A63B 21/00058–00065; A63B 21/055–0557; A63B 21/40–4001; A63B 21/4009; A63B 21/4011–4021; A63B 21/4025; A63B 23/035; A63B 23/08; A63B 23/10; A63B 23/12; A63B 23/14; A63B 23/16

See application file for complete search history.

(56) References Cited

U.S. PATENT DOCUMENTS

| | | | | | |
|---|---|---|---|---|---|
| 4,180,261 | A * | 12/1979 | Kolka | A63B 21/065 2/22 |
| 4,658,442 | A * | 4/1987 | Tomlinson | A63B 21/065 2/102 |
| 5,868,652 | A * | 2/1999 | Spletzer | A63B 21/065 482/105 |
| 9,066,786 | B1 * | 6/2015 | Price | A63B 21/4017 |
| 10,857,415 | B2 * | 12/2020 | Abecasis | A61F 5/0118 |

(Continued)

*Primary Examiner* — Garrett K Atkinson
*Assistant Examiner* — Kathleen M Fisk
(74) *Attorney, Agent, or Firm* — Gearhart Law LLC

(57) ABSTRACT

A wearable exercise apparatus to provide support for a limb-based workout is described. A middle section includes a first D-ring, a second D-ring, and a first fixation member configured to affix to a second fixation member on a portion of a front tapered end. A first rear tapered end is configured to wrap around a limb such that the first D-ring receives the first tapered end therethrough in a first direction. A second rear tapered end is configured to wrap around the limb such that the second D-ring receives the second tapered end therethrough in the first direction. The apparatus is tightened on the limb by: pulling the first and second rear tapered ends in a second direction opposite the first direction through the first and second D-ring, respectively. A weight holder coupled to the middle section is also included.

15 Claims, 5 Drawing Sheets

(56) References Cited

U.S. PATENT DOCUMENTS

| | | | | |
|---|---|---|---|---|
| 2007/0004571 | A1* | 1/2007 | Gonzalez | A63B 21/4005 482/124 |
| 2007/0099774 | A1* | 5/2007 | Bruback | A63B 21/065 482/105 |
| 2008/0070760 | A1* | 3/2008 | Daniel | A63B 21/065 482/105 |
| 2008/0280737 | A1* | 11/2008 | Cook | A63B 21/065 482/105 |
| 2009/0253560 | A1* | 10/2009 | Cook | A63B 21/4007 482/105 |
| 2010/0311551 | A1* | 12/2010 | Winston | A63B 21/0605 482/105 |
| 2013/0210591 | A1* | 8/2013 | Ree | A63B 21/00043 482/124 |
| 2019/0060700 | A1* | 2/2019 | Abecasis | A63B 21/16 |

* cited by examiner

QUAD EXERCISER

CROSS-REFERENCE TO RELATED APPLICATIONS

This application is a U.S. Non-Provisional Patent Application that claims priority from U.S. Provisional Application Ser. No. 62/824,414 filed on Mar. 27, 2019, the entire contents of which are hereby incorporated by reference.

FIELD OF THE EMBODIMENTS

The field of embodiments of the present invention related to an exercise apparatus configured to support a workout associated with a limb of a wearer.

BACKGROUND OF THE EMBODIMENTS

People enjoy working out as a way of staying fit, healthy and in shape. Workout are also important for recovery in relation to sustained injuries. During recovery from an injury, muscles and connective tissue may atrophy. To prevent additional injury, atrophied muscles and connective tissue may be exercised to recover full or partial functionality.

A variety of exercise apparatus may be used to maintain and improve muscle and connective tissue. For example, weight training equipment may be used to focus an exercise on a particular muscle group. However, incrementally altering workout routines to fine tune the workout regimen may necessitate specialized equipment or expensive custom equipment.

Embodiments address issues that arise from workout regimens in relation to limb-based workout routines and customized exercise equipment.

SUMMARY OF THE EMBODIMENTS

The present invention and its embodiments relate a wearable exercise apparatus to provide support for a limb-based workout. A first embodiment of the instant invention describes a wearable exercise apparatus to provide support for a limb-based workout for a user or wearer. The limb is a leg such that the apparatus may be worn on an upper section of the leg of the user. The wearable exercise apparatus comprises a front tapered end, a middle section, a first rear tapered end (e.g., a top rear tapered end), a second rear tapered end (e.g., a bottom rear tapered end), and a weight holder.

The middle section includes a first D-ring located at a first location proximate the first rear tapered end and a second D-ring located at a second location proximate the second rear tapered end, where the first location differs from the second location. The front tapered end also includes a first fastener configured to affix to a second fastener on a portion of the front tapered end. The first and second fastener comprise a Velcro® fastener, or a hook and loop fastener.

The first rear tapered end is configured to wrap around a limb of the user such that the first D-ring receives the first tapered end therethrough in a first direction and is pulled in a second direction opposite the first direction through the first D-ring to tighten the wearable exercise apparatus on the limb of the user. The second rear tapered end is configured to wrap around the limb of the user such that the second D-ring receives the second tapered end therethrough in a first direction and is pulled in the second direction through the second D-ring to tighten the wearable exercise apparatus on the limb of the user.

The weight holder is coupled to the middle section and is configured to hold a first weight strip. The weight holder includes one or more pockets. A first pocket of the one or more pockets is configured to hold the first weight strip. Further, a weight of the wearable exercise apparatus is configured to increase by inserting a second weight strip into a second pocket of the one or more pockets. Additionally, a weight of the wearable exercise apparatus is configured to decrease by removing the first weight strip from the first pocket of the one or more pockets.

A second embodiment of the instant invention describes a wearable leg exercise apparatus configured to provide support for a leg-based workout for a user. The wearable leg exercise apparatus is configured to be worn on an upper section of the leg. The wearable exercise apparatus includes: a front tapered end, a middle section, a first rear tapered end, a second rear tapered end, a weight holder.

The middle section includes a first D-ring located at a first location proximate a first rear tapered end and a second D-ring located at a second location proximate a second rear tapered end, where first location differs from the second location. The front tapered end also includes a first fastener configured to affix to a second fastener on a portion of the front tapered end. The first and second fastener comprise a Velcro® fastener, or a hook and loop fastener.

The first rear tapered end (e.g., a top rear tapered end) is configured to wrap around a limb of the user such that the first D-ring receives the first tapered end therethrough in a first direction and is pulled in a second direction opposite the first direction through the first D-ring to tighten the wearable exercise apparatus on the limb of the user. The second rear tapered end (e.g., a bottom rear tapered end) is configured to wrap around the limb of the user such that the second D-ring receives the second tapered end therethrough in a first direction and is pulled in the second direction through the second D-ring to tighten the wearable exercise apparatus on the limb of the user.

The weight holder is coupled to the middle section. The weight holder includes one or more pockets, and at least one of the one or more pockets is configured to hold a first weight strip.

A third embodiment of the instant invention describes a method of providing support for a leg-based workout with a wearable leg exercise apparatus. The method includes the following process steps: positioning the wearable leg exercise apparatus on an upper section of a leg and fastening the wearable leg exercise apparatus to the upper section of the leg. The process step of fastening the wearable leg exercise apparatus to the upper section of the leg includes: securing a front tapered end of the wearable leg exercise apparatus to a middle section of the wearable leg exercise apparatus via at least one fastener; wrapping a first rear tapered end around the upper section of the leg such that a first D-ring of the middle section receives the first tapered end therethrough in a first direction; wrapping a second rear tapered end around the upper section of the leg such that a second D-ring of the middle section receives the second tapered end therethrough in a first direction; and tightening the wearable exercise apparatus on the limb of the user.

The process step of tightening the wearable exercise apparatus on the limb of the user includes pulling the first rear tapered end in a second direction opposite the first direction through the first D-ring; and pulling the second rear tapered end in the second direction through the second D-ring. The method further includes inserting a weight strip into a weight holder coupled to the middle section. The weight holder includes one or more pockets such that at least one of the one or more pockets is configured to hold the weight strip.

It is an object of the embodiment of the present invention to provide a wearable exercise apparatus.

It is another object of the embodiment of the present invention to provide support for a limb-based workout.

It is yet another object of the embodiment of the present invention to provide a weight holder attached to the middle section.

It is yet another object of the embodiment of the present invention to allow for insertion or removal of weight strips to pockets in the weight holder to increase or decrease a weight of the wearable exercise apparatus.

These and other features, aspects and advantages of the present invention will become better understood with reference to the following drawings, description and claims.

DESCRIPTION OF THE PREFERRED EMBODIMENTS

Figure 1:
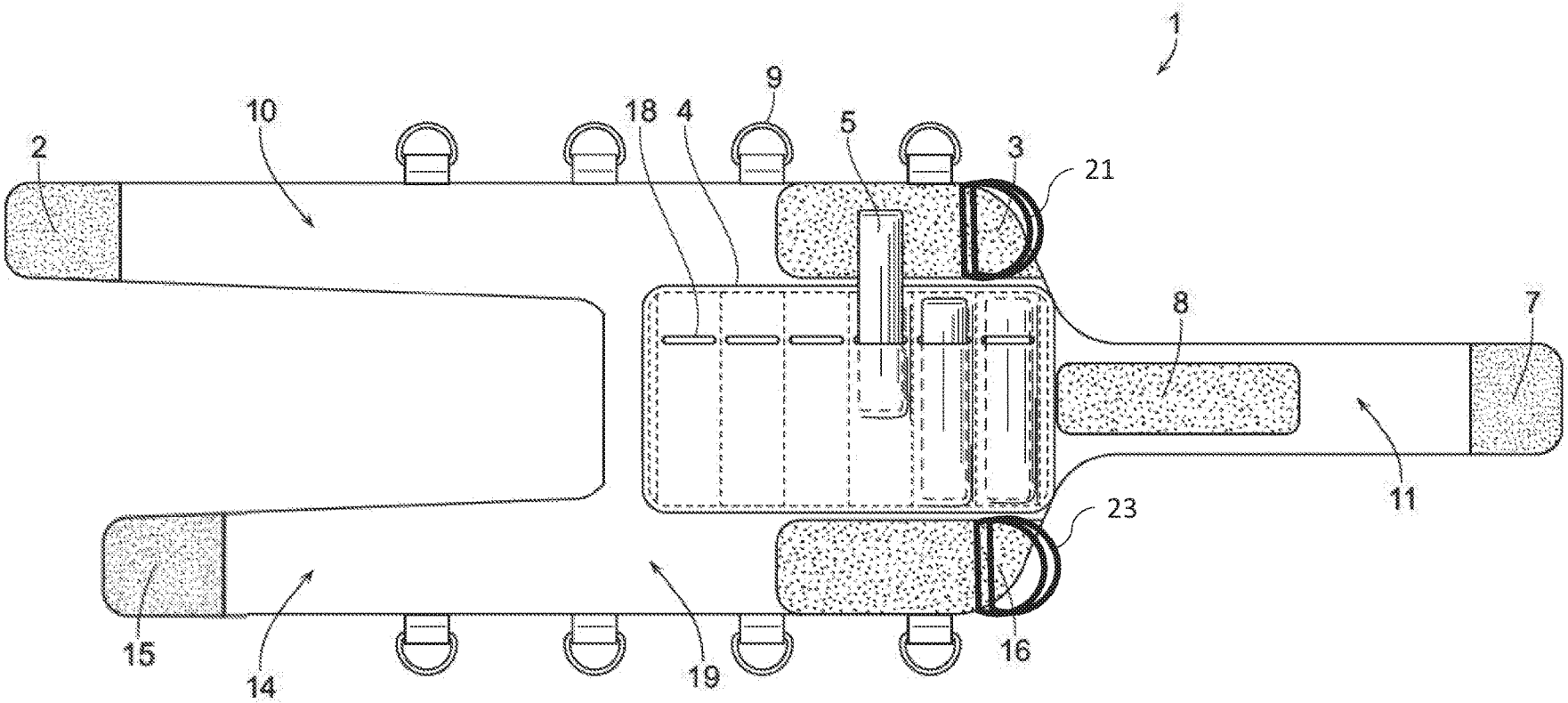
FIG. 1 depicts an expanded view of embodiments of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 depicts an expanded view of a wearable exercise apparatus 1. An example of the wearable exercise apparatus 1 may include a sleeve or a wrap that may be worn on a limb. An example of the limb may include a leg (e.g., a leg 13 of FIG. 3A), an arm, a hand, and/or a foot of a wearer (e.g., a wearer 12 of FIG. 3A). A preferred example of the limb may include the leg 13 (of FIG. 3A). Alternatively, the wearable exercise apparatus 1 may be worn on a non-limb part of the wearer such as a core of a body, a neck, and/or a head of the wearer.

In an example scenario, the wearable exercise apparatus 1 may be composed of a single piece of flexible and wearable material. Alternatively, the wearable exercise apparatus 1 may be composed of multiple pieces and/or multiple layers of a variety of flexible wearable material.

The wearable exercise apparatus 1 may include a front tapered end 11, a first rear tapered end 10 (e.g., a top rear tapered end), and a second rear tapered end 14 (e.g., a bottom rear tapered end). The front tapered end 11 may include first and second fasteners 7, 8. The wearable exercise apparatus 1 may be worn on a limb by wrapping the front tapered end 11 over the limb and affixing the front tapered end 11 to a middle section 19 of the wearable exercise apparatus 1. In examples, the front tapered end 11 may include a first fastener 7 and a portion of the front tapered end 11 may comprise a second fastener 8 such that affixing the first fastener to the second fastener secures the wearable exercise apparatus 1 around the limb of the wearer 12 (of FIG. 3A). In examples, the first and second fasteners comprise a Velcro® fastener, or a hook and loop fastener. However, the first and second fastener are not limited to the examples described herein and other fasteners are contemplated A first D-ring 21 may be located on a component 3 on the middle section 19 and a second D-ring 23 may be located on a component 16 on the middle section 19. The first rear tapered end 10 and the second rear tapered end 14 are wrapped around the limb of the wearer 12 (of FIG. 3A) such that the first D-ring 21 is configured to receive a component 2 located on the first rear tapered end 10 therethrough in a first direction and the second D-ring 23 is configured to receive a component 15 located on the second rear tapered end 14 therethrough in the first direction. Once the first D-ring 21 receives the component 2 and the second D-ring 23 receives the component 15, the component 2 and the component 15 are pulled in a second direction opposite the first direction and through the first D-ring 21 and the second D-ring 23, respectively, to tighten the wearable exercise apparatus 1 on the limb of the wearer 12 (of FIG. 3A).

In another example scenario, a weight holder 4 may be attached to the middle section 19 of the wearable exercise apparatus 1. The weight holder 4 may include one or more pockets, such as a pocket 18. The pocket 18 may be configured to receive a weight strip 5. The weight strip 5 may include an item with a predetermined weight. The pocket 18 may include a mechanism to secure the weight strip 5 so that the weight strip 5 may not dislodge during a workout associated with the limb.

By inserting the weight strip 5 into the pocket 18, the wearer 12 (of FIG. 3A) may increase a weight of the wearable exercise apparatus 1. By increasing the weight of the wearable exercise apparatus 1, the wearer may affect a difficulty of a workout associated with the limb. For example, the wearer 12 (of FIG. 3A) may insert other weight strip(s) into other pocket(s) on the weight holder 4, as such increase the weight of the wearable exercise apparatus 1. The increased weight of the wearable exercise apparatus 1 may increase the difficulty of the workout associated with the limb.

The wearer 12 (of FIG. 3A) may also remove the weight strip 5 from the pocket 18 (or other weight strips from other pockets). Removal of the weight strip 5 (or other weight strips) from the pocket 18 (or other pockets) may decrease a weight of the wearable exercise apparatus 1. The decreased weight of the wearable exercise apparatus 1 may decrease the difficulty of the workout associated with the limb.

The wearable exercise apparatus 1 may also include a fastener 9 (or other fasteners). The fastener 9 (or other fasteners) may be used to attach other item(s) associated with the workout of the limb. Alternatively, the fastener 9 (or other fasteners) may be used to attach other items or objects associated with other scenarios in relation to the limb wearing the wearable exercise apparatus 1.

Figure 2:
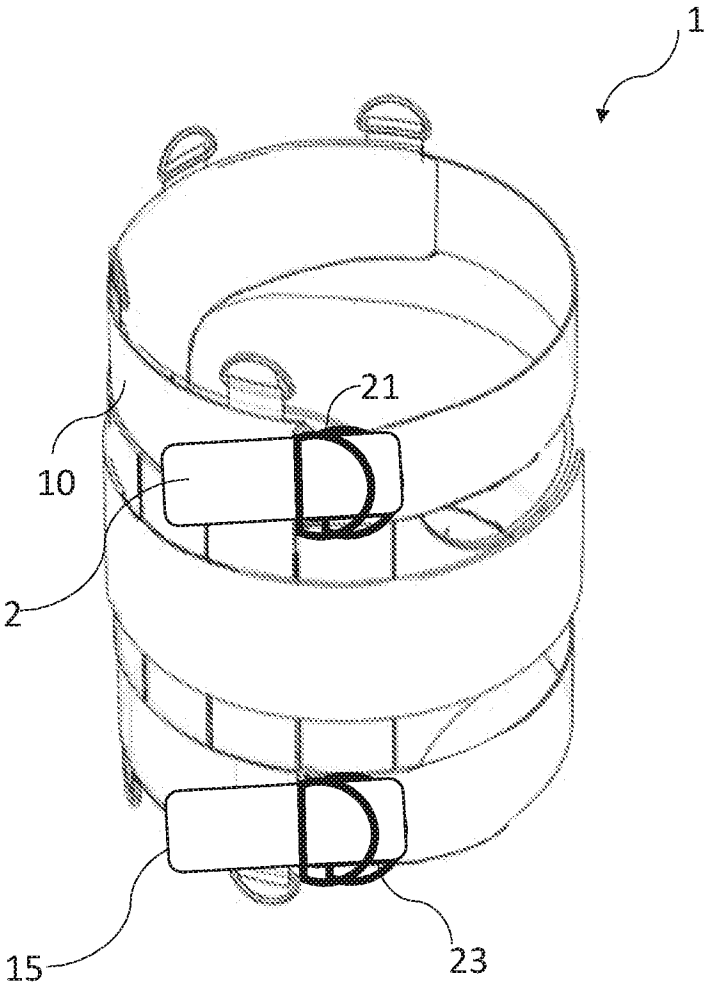
FIG. 2 depicts a folded view of an embodiment of the present invention.

FIG. 2 depicts a folded view of the wearable exercise apparatus 1. The wearable exercise apparatus 1 may be secured on a limb of a wearer by folding the wearable exercise apparatus 1 over the limb. As described and depicted in FIG. 1, the front tapered end 11 may include the first fastener 7 and the front tapered end 11 may comprise the second fastener 8 such that affixing the first fastener to the second fastener secures the wearable exercise apparatus 1 around the limb of the wearer 12 (of FIG. 3A). In examples, the first and second fastener comprise a Velcro® fastener, or a hook and loop fastener.

Moreover, the first D-ring 21 may be located on the component 3 on the middle section 19 and the second D-ring 23 may be located on the component 16 on the middle section 19. The first rear tapered end 10 and the second rear tapered end 14 are wrapped around the limb of the wearer 12 (of FIG. 3A) such that the first D-ring 21 is configured to receive the component 2 located on the first rear tapered end 10 therethrough in the first direction and the second D-ring 23 is configured to receive the component 15 located on the second rear tapered end 14 therethrough in the first direction. Once the first D-ring 21 receives the component 2 and the second D-ring 23 receives the component 15, the component 2 and the component 15 are pulled in a second direction opposite the first direction and through the first D-ring 21 and the second D-ring 23, respectively, to tighten the wearable exercise apparatus 1 on the limb of the wearer 12 (of FIG. 3A).

Figure 3A:
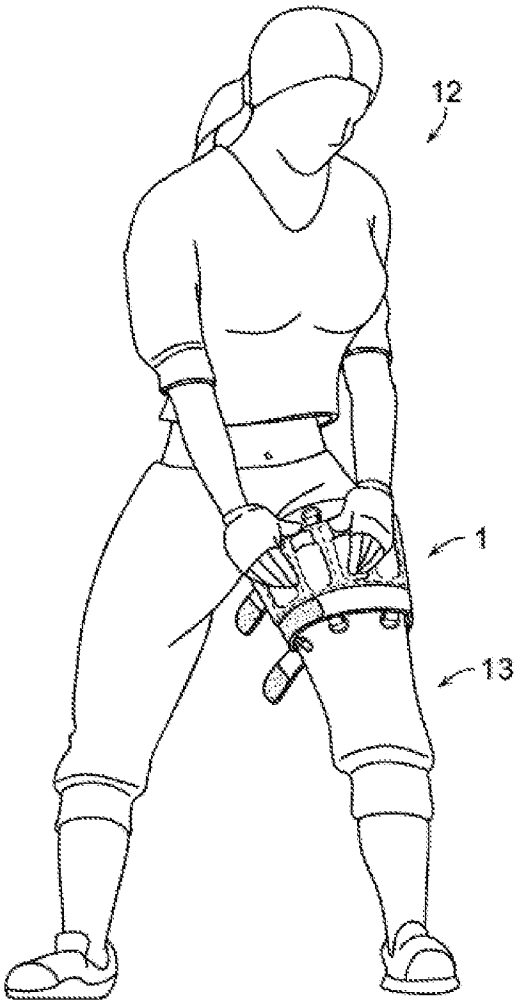
FIG. 3A and FIG. 3B depict in-use views of an embodiment of the present invention.
Figure 3B:
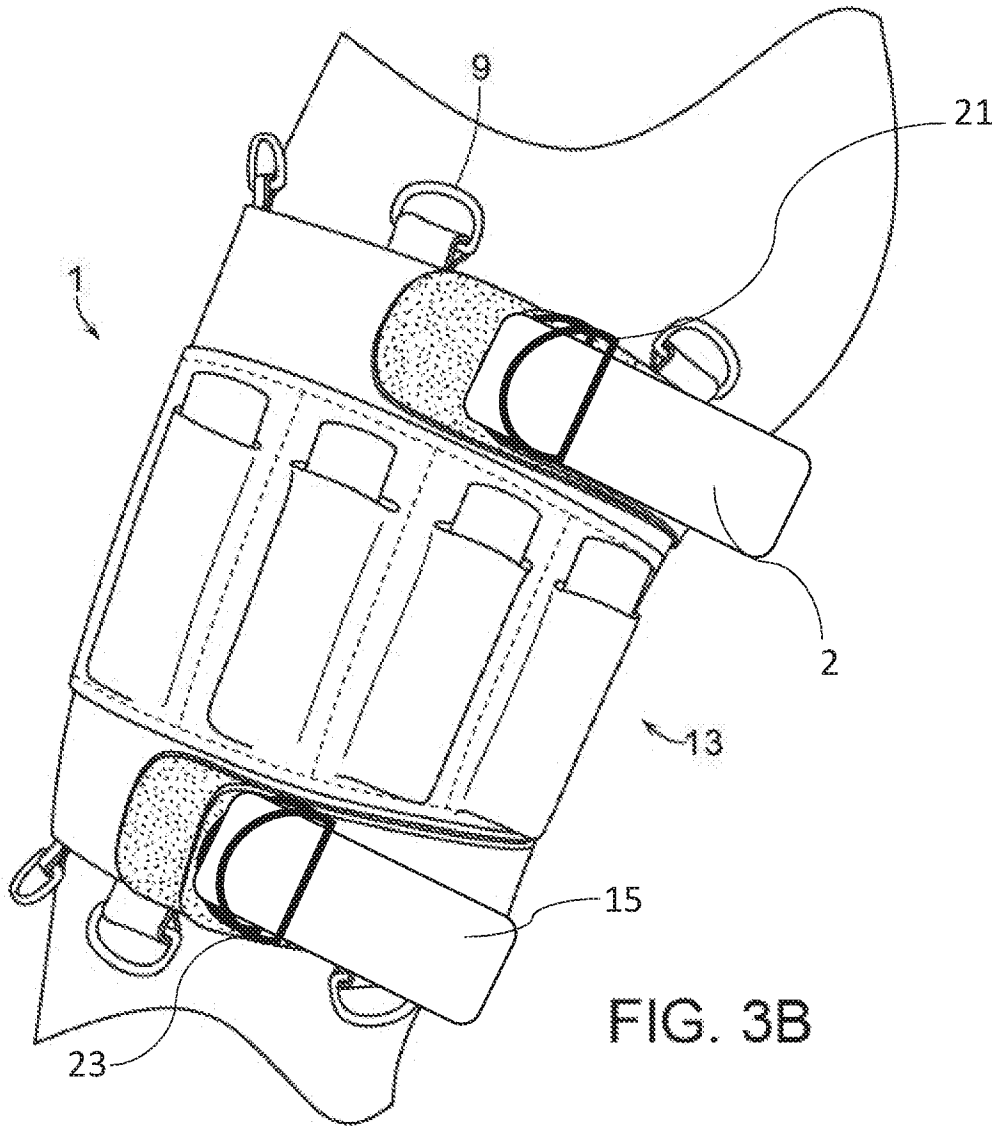

FIG. 3A-3B show in-use views of the wearable exercise apparatus 1. The wearable exercise apparatus 1 may be folded and secured over an upper (or lower) section of a leg 13 of a wearer 12. The wearable exercise apparatus 1 may be used to support a workout associated with the leg 13. The wearer 12 may insert or remove weight strip(s) to/from the wearable exercise apparatus 1 to increase or decrease a weight of the wearable exercise apparatus 1. The increased or decreased weight of the wearable exercise apparatus 1 may increase or decrease a difficulty of the workout associated with the leg 13. The fastener 9 may be attached to an item or an object associated with the workout of the leg 13.

Figure 4:
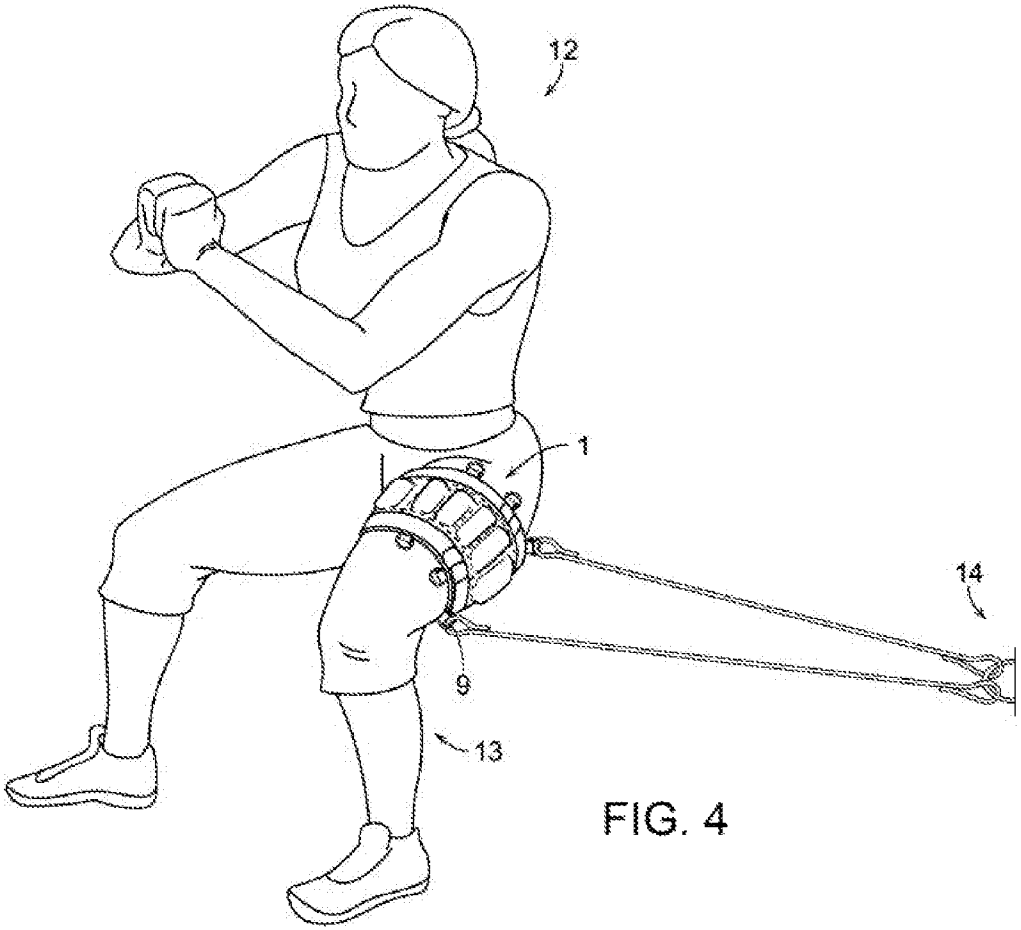
FIG. 4 depicts another view of an embodiment of the present invention.

FIG. 4 shows another in-use view of the wearable exercise apparatus 1. The wearable exercise apparatus 1 may be attached to a resistance band 14 through the fastener 9. The wearer 12 may accomplish a workout of the leg 13 using the resistance band 14 that is attached to the wearable exercise apparatus 1.

A method of providing support for a leg-based workout with a wearable leg exercise apparatus is also described. The method may include positioning the wearable leg exercise apparatus on an upper section of a leg and fastening the wearable leg exercise apparatus to the upper section of the leg. The process step of fastening the wearable leg exercise apparatus to the upper section of the leg may include the following process steps: securing a front tapered end of the wearable leg exercise apparatus to a middle section of the wearable leg exercise apparatus via at least one fastener; wrapping a first rear tapered end around the upper section of the leg such that a first D-ring of the middle section receives the first tapered end therethrough in a first direction; wrapping a second rear tapered end around the upper section of the leg such that a second D-ring of the middle section receives the second tapered end therethrough in a first direction; and tightening the wearable exercise apparatus on the limb of the wearer.

The process step of tightening the wearable exercise apparatus on the limb of the wearer may include: pulling the first rear tapered end in a second direction opposite the first direction through the first D-ring; and pulling the second rear tapered end in the second direction through the second D-ring. The method may further include: inserting a weight strip into a weight holder coupled to the middle section.

In addition to the foregoing, other objects, features, aspects and advantages of the present invention will be better comprehended through a careful reading of a detailed description provided herein below with appropriate reference to the accompanying drawings.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A wearable exercise apparatus to provide support for a limb-based workout for a user, the wearable exercise apparatus comprising:

a front tapered end;

a first fastener configured to affix to a second fastener, with both of the first fastener and the second fastener being located on the front tapered end;

a middle section comprising:

a first D-ring located at a first location proximate a first rear tapered end;

a second D-ring located at a second location proximate a second rear tapered end, wherein the first location differs from the second location;

the first rear tapered end being configured to wrap around a limb of the user such that the first D-ring receives the first rear tapered end therethrough in a first direction and is pulled in a second direction opposite the first direction through the first D-ring to tighten the wearable exercise apparatus on the limb of the user;

the second rear tapered end being configured to wrap around the limb of the user such that the second D-ring receives the second rear tapered end therethrough in the first direction and is pulled in the second direction through the second D-ring to tighten the wearable exercise apparatus on the limb of the user;

a weight holder coupled to the middle section, wherein the weight holder is configured to hold a first weight strip; and a plurality of fasteners disposed at a top edge of the middle section, a bottom edge of the middle section, a top edge of the first rear tapered end, and a bottom edge of the second rear tapered end.

2. The wearable exercise apparatus of claim 1, wherein the weight holder includes one or more pockets.

3. The wearable exercise apparatus of claim 2, wherein a first pocket of the one or more pockets is configured to hold the first weight strip.

4. The wearable exercise apparatus of claim 3, wherein a weight of the wearable exercise apparatus is configured to increase by inserting a second weight strip into a second pocket of the one or more pockets.

5. The wearable exercise apparatus of claim 3, wherein a weight of the wearable exercise apparatus is configured to decrease by removing the first weight strip from the first pocket of the one or more pockets.

6. The wearable exercise apparatus of claim 1, wherein the wearable exercise apparatus is configured to be worn on a leg of the user.

7. The wearable exercise apparatus of claim 6, wherein the wearable exercise apparatus is configured to be worn on an upper section of the leg.

8. A method of providing support for a leg-based workout, the method comprising:

providing the wearable exercise apparatus of claim 1;

positioning the wearable exercise apparatus on an upper section of a leg of the user;

fastening the wearable exercise apparatus to the upper section of the leg by:

securing the front tapered end of the wearable exercise apparatus to the middle section of the wearable exercise apparatus via the first and second fastener;

wrapping the first rear tapered end around the upper section of the leg such that the first D-ring of the middle section receives the first rear tapered end therethrough in the first direction;

wrapping the second rear tapered end around the upper section of the leg such that the second D-ring of the middle section receives the second rear tapered end therethrough in the first direction;

tightening the wearable exercise apparatus on the leg of the user by:

pulling the first rear tapered end in the second direction opposite the first direction through the first D-ring; and pulling the second rear tapered end in the second direction through the second D-ring; and inserting the first weight strip into the weight holder coupled to the middle section.

9. The method of claim 8, wherein the weight holder includes one or more pockets such that at least one of the one or more pockets is configured to hold the first weight strip.

10. The wearable exercise apparatus of claim 1, wherein the first fastener and the second fastener comprise a hook and loop fastener.

11. The wearable exercise apparatus of claim 1, wherein the first rear tapered end is a top rear tapered end, and wherein the second rear tapered end is a bottom rear tapered end.

12. A wearable leg exercise apparatus to provide support for a leg-based workout for a user, the wearable exercise apparatus comprising:

a front tapered end;

a first fastener configured to affix to a second fastener, with both of the first fastener and the second fastener being located on the front tapered end;

a middle section comprising:

a first D-ring located at a first location proximate a first rear tapered end;

a second D-ring located at a second location proximate a second rear tapered end, wherein the first location differs from the second location;

the first rear tapered end being configured to wrap around a limb of the user such that the first D-ring receives the first rear tapered end therethrough in a first direction and is pulled in a second direction opposite the first direction through the first D-ring to tighten the wearable exercise apparatus on the limb of the user;

the second rear tapered end being configured to wrap around the limb of the user such that the second D-ring receives the second rear tapered end therethrough in the first direction and is pulled in the second direction through the second D-ring to tighten the wearable exercise apparatus on the limb of the user;

a weight holder coupled to the middle section, wherein the weight holder includes one or more pockets, and wherein at least one of the one or more pockets is configured to hold a first weight strip; and a plurality of fasteners disposed at a top edge of the middle section, a bottom edge of the middle section, a top edge of the first rear tapered end, and a bottom edge of the second rear tapered end.

13. The wearable exercise apparatus of claim 12, wherein the wearable exercise apparatus is configured to be worn on an upper section of a leg of the user.

14. The wearable exercise apparatus of claim 12, wherein the first fastener and the second fastener comprise a hook and loop fastener.

15. The wearable exercise apparatus of claim 12, wherein the first rear tapered end is a top rear tapered end, and wherein the second rear tapered end is a bottom rear tapered end.

* * * * *